US006715581B2

(12) United States Patent
Dooley

(10) Patent No.: US 6,715,581 B2
(45) **Date of Patent: *Apr. 6, 2004**

(54) EXHAUST PIPE AND MUFFLER FOR MOTORCYCLE THAT DOES NOT HEAT DISCOLOR

(76) Inventor: Mark W. Dooley, 6374 E. Paseo Celeste, Anaheim Hills, CA (US) 92807

( * ) Notice: Subject to any disclaimer, the term of this patent is extended or adjusted under 35 U.S.C. 154(b) by 0 days.

This patent is subject to a terminal disclaimer.

(21) Appl. No.: 10/179,052

(22) Filed: Jun. 25, 2002

(65) Prior Publication Data

US 2002/0153196 A1 Oct. 24, 2002

Related U.S. Application Data

(63) Continuation-in-part of application No. 09/516,843, filed on Mar. 2, 2000, now Pat. No. 6,408,980.

(51) Int. Cl.[7] ..... F01N 7/08; F01N 7/00; F02M 35/00

(52) U.S. Cl. ..... 181/228; 181/227; 181/212

(58) Field of Search ..... 181/227, 228, 181/249, 255, 282, 246, 262, 244, 245, 232, 212, 238, 247, 248; 180/89.2, 309

(56) References Cited

U.S. PATENT DOCUMENTS

| | | | | |
|---|---|---|---|---|
| 3,104,733 A | | 9/1963 | Ludlow | |
| 3,382,948 A | * | 5/1968 | Walker et al. | 181/250 |
| 3,479,145 A | * | 11/1969 | Lentz | 422/181 |
| 3,500,954 A | * | 3/1970 | Willette | 181/227 |
| 3,677,365 A | | 7/1972 | Wright et al. | |
| 3,858,678 A | | 1/1975 | Haren | |
| 4,356,885 A | | 11/1982 | Dello | |
| 4,419,113 A | * | 12/1983 | Smith | 55/484 |
| 4,487,289 A | | 12/1984 | Kicinski et al. | |

(List continued on next page.)

FOREIGN PATENT DOCUMENTS

| | | | | |
|---|---|---|---|---|
| DE | 199 12 466 A1 | | 10/1999 | |
| EP | 0 448 728 A1 | | 10/1991 | |
| JP | 60175720 A | * | 9/1985 | 181/212 |

OTHER PUBLICATIONS

Patent Abstracts of Japan, vol. 012, No. 134 (M–689), Apr. 23, 1988—& JP 62 255514 A (Yamaha Motor Co., Ltd.), Nov. 7, 1987 abstract; figures 1–8.

Patent Abstracts of Japan, vol. 1998, No. 05, Apr. 30, 1998—& JP 10–002220 A (Suzuki Motor Corp.), Jan. 6, 1998 abstract; figures 1–3.

Patent Abstracts of Japan, vol. 008, No. 158 (M–311), Jul. 21, 1984—& JP 59 054722 A (Honda Giken Kogyo KK), Mar. 29, 1984 abstract; figures 1–5.

White Brothers American Street Catalog #20, 1998.

*Primary Examiner*—Robert Nappi
*Assistant Examiner*—Patrick L Miller

(57) ABSTRACT

A chromed exhaust pipe and muffler for motorcycles that is capable of withstanding the extreme heat generated at high rpm's of a motorcycle engine without discoloring or "bluing". A double wall construction is utilized for the exhaust pipe and muffler with the back side of the exterior chromed pipe cut away along the length of the pipe from the mounting flange to the muffler core. The cut-away exterior pipe is dimensional to allow the interior pipe to be inserted in one piece from the mounting flange to the muffler core, as well as cooling the exterior pipe, thereby preventing heat discoloration of the exterior chromed pipe. Spacers are welded to the interior pipe and the exterior pipe at the backside cut-away of the exterior pipe to space the interior pipe within the exterior pipe. The muffler core includes a baffle core enclosed by an interior pipe section, allowing gases to flow out the back end only. The interior pipe is spaced apart from and enclosed in the exterior chromed pipe. The double walled muffler section prevents discoloration and reduces heat transfer to the exterior chromed pipe. For dual pipes, the double wall construction is utilized on each separate pipe. Both pipes then attach to a Y-shaped collector which is part of a muffler core, both being enclosed by an exterior chromed pipe.

15 Claims, 6 Drawing Sheets

U.S. PATENT DOCUMENTS

| | | | | |
|---|---|---|---|---|
| 5,036,947 | A | | 8/1991 | Metzger |
| 5,388,408 | A | | 2/1995 | Lawrence |
| 5,464,952 | A | | 11/1995 | Shah et al. |
| 5,508,478 | A | | 4/1996 | Barry |
| 5,799,395 | A | | 9/1998 | Nording et al. |
| 5,907,134 | A | | 5/1999 | Nording et al. |
| 5,966,933 | A | | 10/1999 | Ishihara et al. |
| 6,026,930 | A | * | 2/2000 | Ogisu et al. ..... 181/228 |
| 6,408,980 | B1 | * | 6/2002 | Dooley ..... 181/228 |
| 6,431,311 | B1 | * | 8/2002 | Brown et al. ..... 181/282 |
| 2002/0050419 | A1 | * | 5/2002 | Dooley ..... 181/228 |
| 2002/0166719 | A1 | * | 11/2002 | Dooley ..... 181/228 |

* cited by examiner

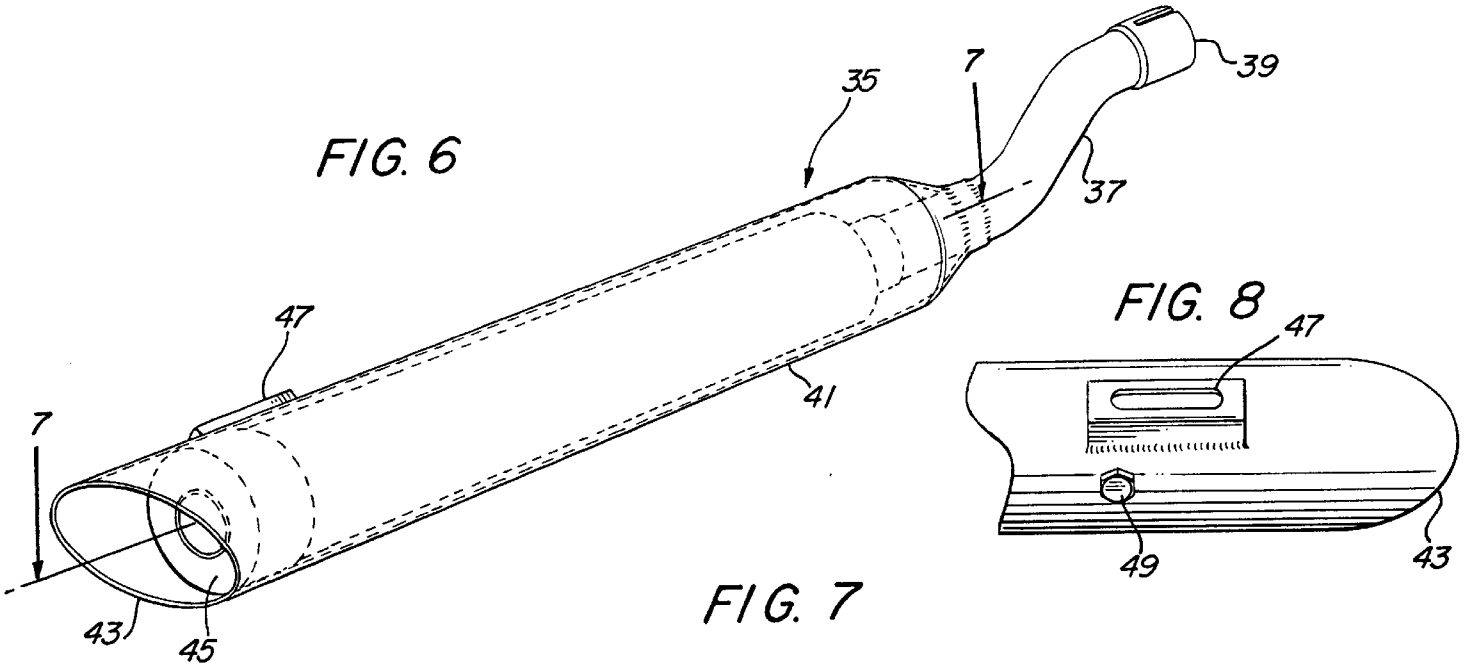
FIG. 6
FIG. 8
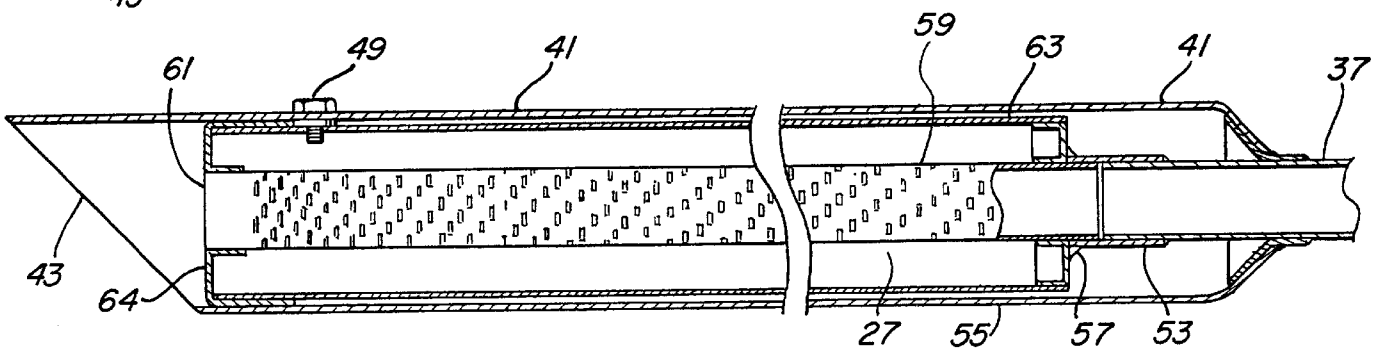
FIG. 7

11
11
99
101
103
113
97
93
91
95

135
145
143
137
14
141
14
139
129
123
121
115
125
117
119
127
131

EXHAUST PIPE AND MUFFLER FOR MOTORCYCLE THAT DOES NOT HEAT DISCOLOR

CROSS-REFERENCE TO RELATED APPLICATIONS

This application is a continuation-in-part of application Ser. No. 09/516,843 filed Mar. 2, 2000, now U.S. Pat. No. 6,408,980 for Exhaust Pipe And Muffler For Motorcycle That Does Not Heat Discolor.

BACKGROUND OF THE INVENTION

1. Field of the Invention

The present invention relates generally to improvements in hot exhaust gas pipes and mufflers and more particularly pertains to new and improved decorative exhaust gas pipes and mufflers used on motorcycles and customized automobiles.

2. Description of Related Art

One of the most critical problems confronting the developers of motorcycle exhaust pipes and mufflers or exhaust pipes and mufflers for automobiles which are exposed for appearance purposes has been the prevention of heat discolorization of the chromed exhaust pipes and muffler casings from the extreme heat generated by high engine performance.

Although the prior art has been concerned with preventing heat transfer to the outer housing of a motorcycle exhaust system, none have really accomplished that goal, none have prevented heat discoloration as the present invention. U.S. Pat. No. 4,356,885 for a Chambered-Core Motorcycle-Exhaust Apparatus was granted on Nov. 2, 1982 to Christy J. Dello. The exhaust system described in the Dello patent is concerned with a double wall exhaust system wherein the inner core is mounted within a tubular housing having a larger diameter than the inner core so as to establish an annular chamber between the outer housing and the inner exhaust core. Dello specifically requires the use of an inner exhaust core system that has a plurality of interconnected pipe segments.

U.S. Pat. No. 3,858,678 was granted Jan. 7, 1975 for a Muffler With Rotary Gas Flow to Ralph Haren. It is directed to a muffler construction that has an outer shell which is clamped to the ends of a flow tube which contains flow obstruction devices to prevent or restrict straight through gas flow.

U.S. Pat. No. 3,104,733 was granted Sep. 24, 1963 for a Sound Attenuating Gas Pipe to Edmund Ludlow. It is directed to an exhaust system which has an outer pipe with a plurality of sections or inserts mounted within the outer pipe that are coaxially aligned within the outer pipe to define a main gas flow passage therethrough. The combination is designed so that each adjacent pair of inserts act in combination with the adjacent wall of the outer pipe to define a "resonating chamber of volume".

U.S. Pat. No. 5,799,395 was granted Sep. 1, 1998 and U.S. Pat. No. 5,907,134 was granted May 25, 1999 for Air Gap-Insulated Exhaust Pipe And Process For Manufacturing An Air Gap-Insulated Exhaust Pipe to Thomas Nording, et al. Both patents are directed to a double wall exhaust pipe wherein the inner pipe which is comprised of sections connected by a sliding fit which are prevented from contacting the walls of the outer pipe as the result of the thermal expansion of both pipes during operation.

FIG. 9 illustrates a prior art double wall exhaust pipe construction for motorcycles made and sold by Hooker. The internal hot gas bearing pipe 69 connects to the engine by a mounting flange 71 and routes the hot gases to its output end 73. The internal pipe 69 is mounted in a larger diameter external pipe 67 which has a cut-away section 75 that runs the length and shape of the internal pipe 69. The output end 73 of the internal pipe 69 slips into a slip joint 77 and is held in place by a plurality of hose clamps 79, 81 and 83 which are held to the inside of the external pipe 67 by loops 78, 80 and 82. Besides not being a very secure mounting, the heat transfer from the internal pipe 69 to the external pipe 67 still presents bluing problems. Various coatings on the internal pipe, such as a ceramic coating have been tried to prevent the bluing problem. The pipes come without a muffler. However, a muffler core can be accommodated at the output end 87 of the external pipe 67. The manufacturer recommends using either a louvered core or a tuned core. Inserting a louvered into the output end 87 of the external pipe 67 creates a single wall muffler with the hot exhaust gases contacting the internal surface of the external pipe 67 at the output end 87. This creates bluing of the output end 87. A tuned core is simply a pipe extension that may vary in diameter from the internal pipe 67.

Applicant's double wall pipes and muffler have solved the heat discoloration problem which the prior art has been unable to do.

SUMMARY OF THE INVENTION

A decorative chromed exhaust pipe for internal combustion engines is provided which does not discolor from the heat generated by the exhaust gases flowing from the engine through the pipes and to and through the muffler. A double-walled muffler is completely encased by an interior casing which only allows gases to flow out the back end of the housing. The exhaust pipe, from the mounting flange to the double-walled muffler has a double wall construction with the exterior wall chromed. The exterior chromed pipe is cut-away on its back side, from the mounting flange to the muffler, allowing the interior one piece pipe to be inserted through the cut-away section and be air cooled during movement. Mounting flanges are welded to the exterior and interior pipes at the back for mounting the exhaust pipe to the vehicle and to hold the interior pipe in a spaced apart relation to the exterior pipe. For larger pipes, separate spacers are welded to the exterior and interior pipes to hold the interior pipe in a spaced relation to the exterior pipe. During operation, the cut-away back side of the exterior pipe provides cooling to the exterior pipe sufficient to prevent heat discoloration of the exterior pipe under the heaviest load conditions. The double-walled construction of the muffler with an air layer between the outside wall and the inside wall prevents the muffler from bluing. In the case of dual exhaust pipes, a Y-shaped collector routes the exhaust from both pipes into the double-walled muffler.

BRIEF DESCRIPTION OF THE DRAWINGS

The exact nature of this invention as well as its objects and many of the attendant advantages will be readily appreciated as the invention becomes better understood upon consideration of the following detailed description in relation to the accompanying drawings in which like reference numerals designate like parts throughout the figures thereof and wherein:

FIG. 6 is a perspective of the muffler according to the present invention;

FIG. 7 is a section of the device of FIG. 6 taken along line 7—7 of FIG. 6; and FIG. 8 is a plan view showing a portion of the output end of the muffler of FIG. 6;

DETAILED DESCRIPTION OF THE PREFERRED EMBODIMENTS

Figures 1, 2, 3, 4, 5:
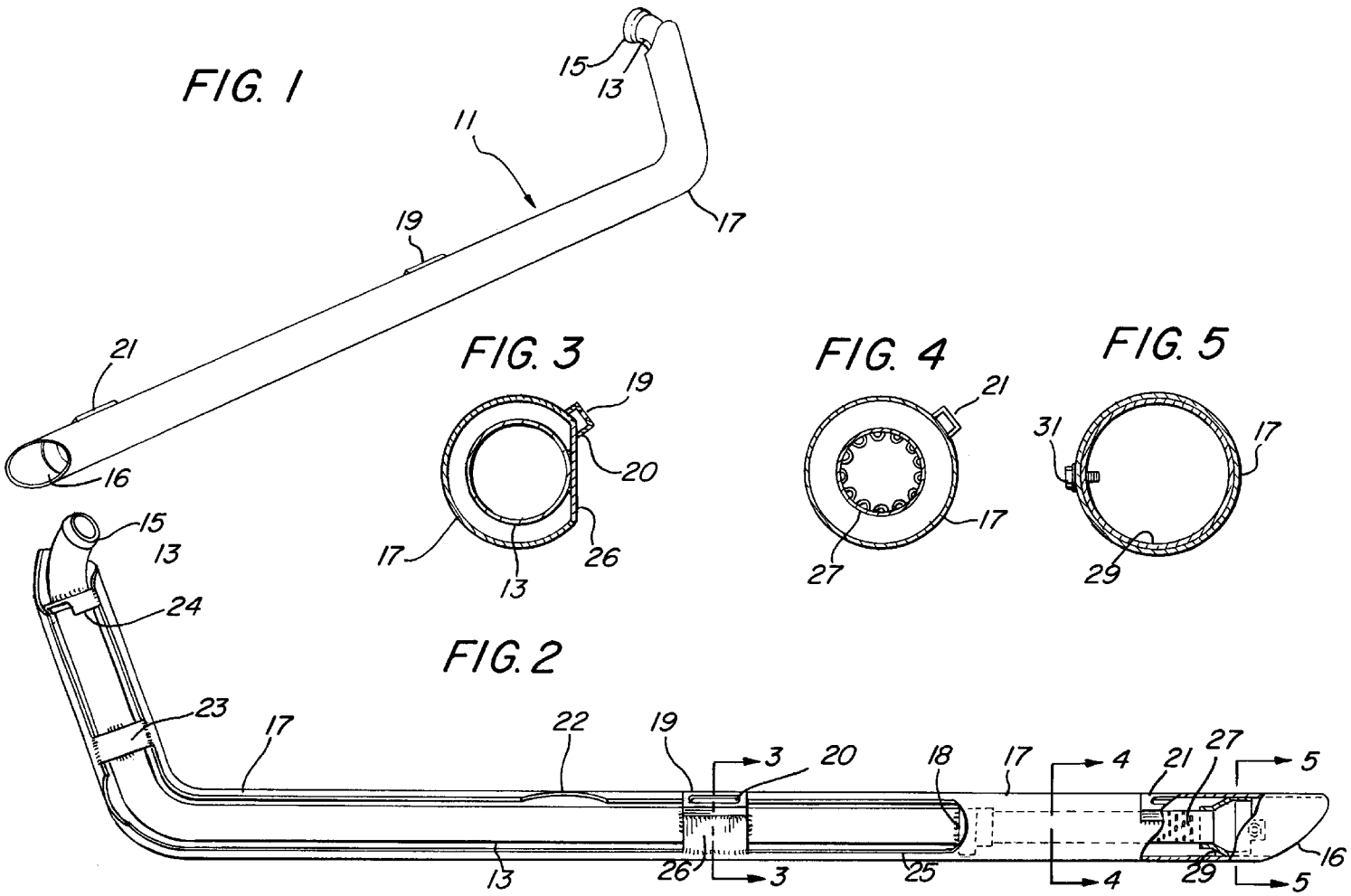
FIG. 1 is a perspective of a preferred embodiment of the present invention.
FIG. 2 is a plan view, partly in section, of the preferred embodiment of FIG. 1.
FIG. 3 is a sectional view of the device of FIG. 2 taken along line 3—3 of FIG. 2.
FIG. 4 is a section of the device of FIG. 2 taken along line 4—4 of FIG. 2.
FIG. 5 is a section of a device of FIG. 2 taken along line 5—5 of FIG. 2.
Figure 9:
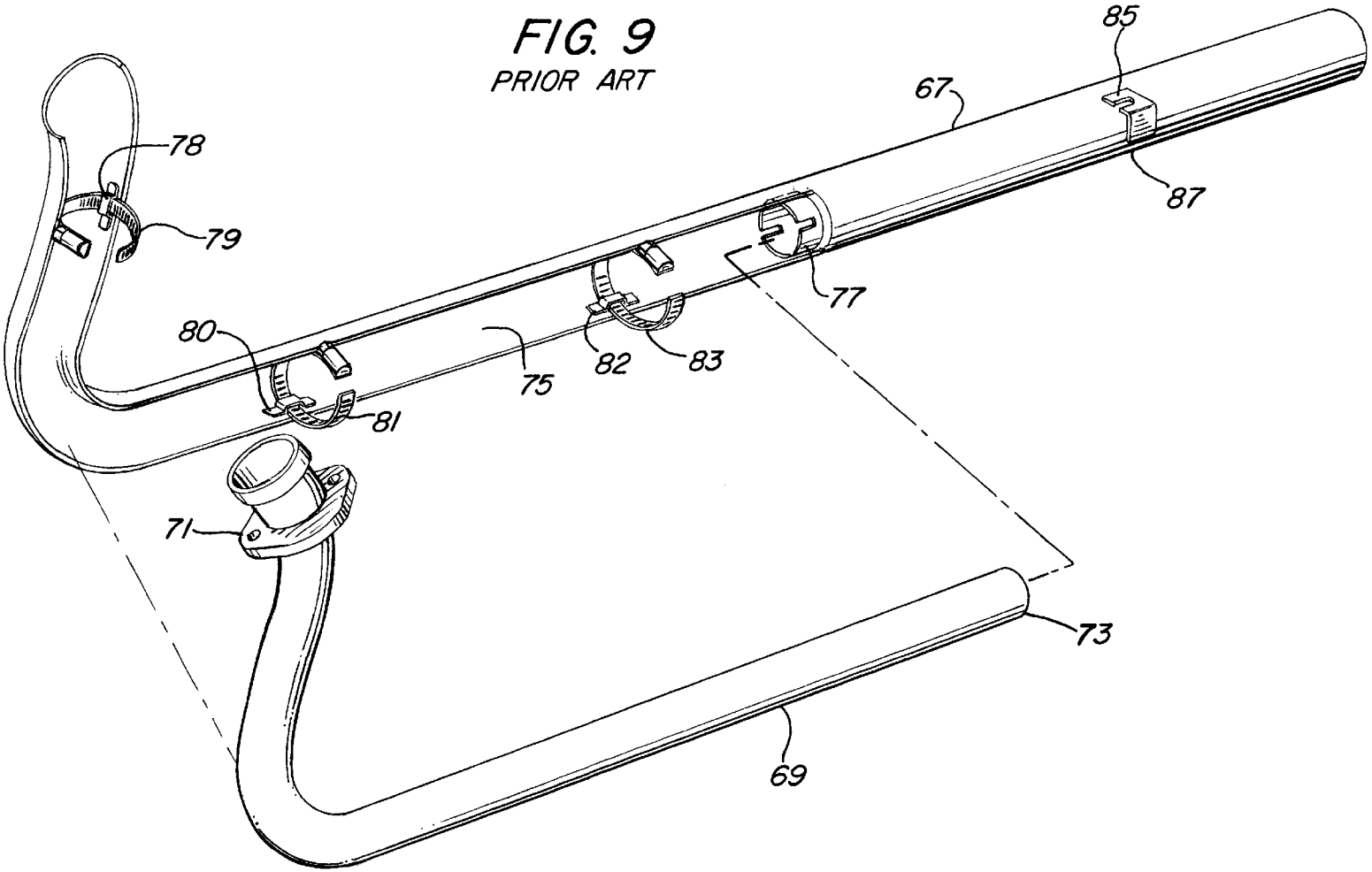
FIG. 9 PRIOR ART
FIG. 9 is an exploded perspective of a prior art double wall motorcycle pipe construction.

FIG. 1 shows the exhaust pipe, muffler combination 11 of the present invention in one of the many possible forms that it may take. Although FIG. 1 illustrates that the pipe and muffler combination 11 only has one bend along its length, it could be straight, or have multiple bends, as required to follow the lines of the particular motorcycle or automobile that it is designed to fit.

The exhaust pipe and muffler 11 is essentially made up of two pipes, one within the other. An internal pipe 13 has a mounting flange at a first or inlet end 15 for mounting to the header of a motorcycle or automobile. An external pipe 17 which is larger in diameter than the internal pipe 13, surrounds the outwardly facing side (front side) of the internal pipe 13 so that the appearance to a viewer is of only one pipe. The diameter of external pipe 17 has an exhaust or outlet end 16. A pair of mounting brackets 19 and 21 are welded to the backside of the exhaust pipe 17 for mounting the pipe assembly to the vehicle.

FIG. 2 illustrates the back side of the dual wall exhaust pipe 11 of the present invention. The back side is the side that faces the vehicle and is not observable by a casual viewer when the exhaust pipe and muffler combination is mounted to the vehicle. As can be seen in FIG. 2, the internal pipe 13 which carries the exhaust gases is a single pipe extending all the way from its first input flange end 15 to its output or second end 18 which slips into a muffler core 27. The external pipe 17 surrounds the internal pipe 13 completely on the front side and is cut away at the back side along its length from the mounting flange 15 of internal pipe 13 all the way to the input end 18 of the muffler core 27.

This cut away or aperture 25 has a width which exceeds the diameter of the internal pipe 13. Dimensioning the aperture 25 in width and length in this manner accomplishes two things. First and foremost, it provides an exceptional amount of cooling to the external pipe 17. Even during peak extended performance, external pipe 17 will not become discolored from heating by the hot exhaust gases passing through internal pipe 13. This discolorization is also known as "bluing". Secondly, the length and breadth of aperture 25 allows the invention to be manufactured simply and swiftly, by permitting the internal pipe 13, regardless of the bends in the pipe, to be inserted into the external pipe 17 in one piece through the aperture 25.

A muffler core 27 which includes a slip joint 18 at its input end and a baffle spacer 29 at its output end is held in place by a nut 31 passing through the external pipe 17 into the baffle 29 of muffler 27. After internal pipe 13 has been slipped into external pipe 17, with its output end inserted into slip joint 18 of the muffler core 27, various spacer support members are welded in place to maintain an even distribution of spacing between the internal exhaust pipe 13 and the external pipe 17. At the input end, at mounting flange 15, a support spacer 24 is welded to internal pipe 13 and external pipe 17. Before the first bend in the pipes, a second support 23 is welded to internal pipe 13 and external pipe 17. Another support member 26 is mounted further on down the length of the exhaust pipe. This support member also contains a mounting bracket 20 having mounting slot 19 to facilitate the mounting of the exhaust pipe to the motorcycle or vehicle by a nut and bolt arrangement. Another mounting bracket 21 is located at the output end 16 of the exhaust pipe.

As can be seen in FIGS. 3, 4, and 5, which are cross-sections of different portions of FIG. 2, looking in the direction of the arrows 3—3, 4—4, and 5—5, once assembled the exhaust pipe and muffler combination 11 of the invention appears and functions as a single unit. The muffler core 27 has a solid external surface with a baffle structure inside thereby allowing gases to flow only out the back end. A preferred structure for the muffler core 27 is shown in FIG. 7 and described below.

Refer now to FIG. 6 which shows a preferred embodiment of the double wall muffler 35 of the present invention. Pipe 37 has a slip joint 39 for mounting to an exhaust pipe or port of the vehicle. An input end of pipe 37 is inserted into one end of external casing 41 and welded circumferentially around the other end so as to maintain pipe 37 evenly spaced within external casing 41. The output end 43 of external casing 41 is also the output end 45 of a muffler core which is more clearly illustrated in FIG. 7.

The muffler core 27 is completely contained within external casing 41. The muffler core 27 has an interior casing 63 which contains within it a baffle core 59 that is welded into interior casing 63 at the input ends by a circumferential weld 57. A slip joint 53 on the interior muffler casing 63 receives input pipe 37. The output end 61 of the baffle core 59 contained within interior casing 63 is supported and baffled by a donut-shaped end unit 64 so that exhaust gases entering the internal casing 63 of muffler 35 by way of pipe 37 are only permitted to exit at output opening 61 of baffle core 59.

The baffle core 59 is completely enclosed except for its input end and output end 61 by the internal casing 63. Internal casing 63 is in turn completely contained within the external casing 41. Internal casing 63 with its baffle core 59 permanently contained therein may be removed from external casing 41 for replacement purposes by loosening bolt 49 which fastens the output end of internal casing 63 to the external casing 41.

The muffler includes a mounting bracket 47 (FIG. 8) for mounting it to the motorcycle or automobile.

This particular construction of a double wall muffler provides two highly desirable results. The exterior casing 41 is much cooler to the touch and the overall operation of the muffler is much quieter than prior art double wall mufflers.

Figures 10, 13:
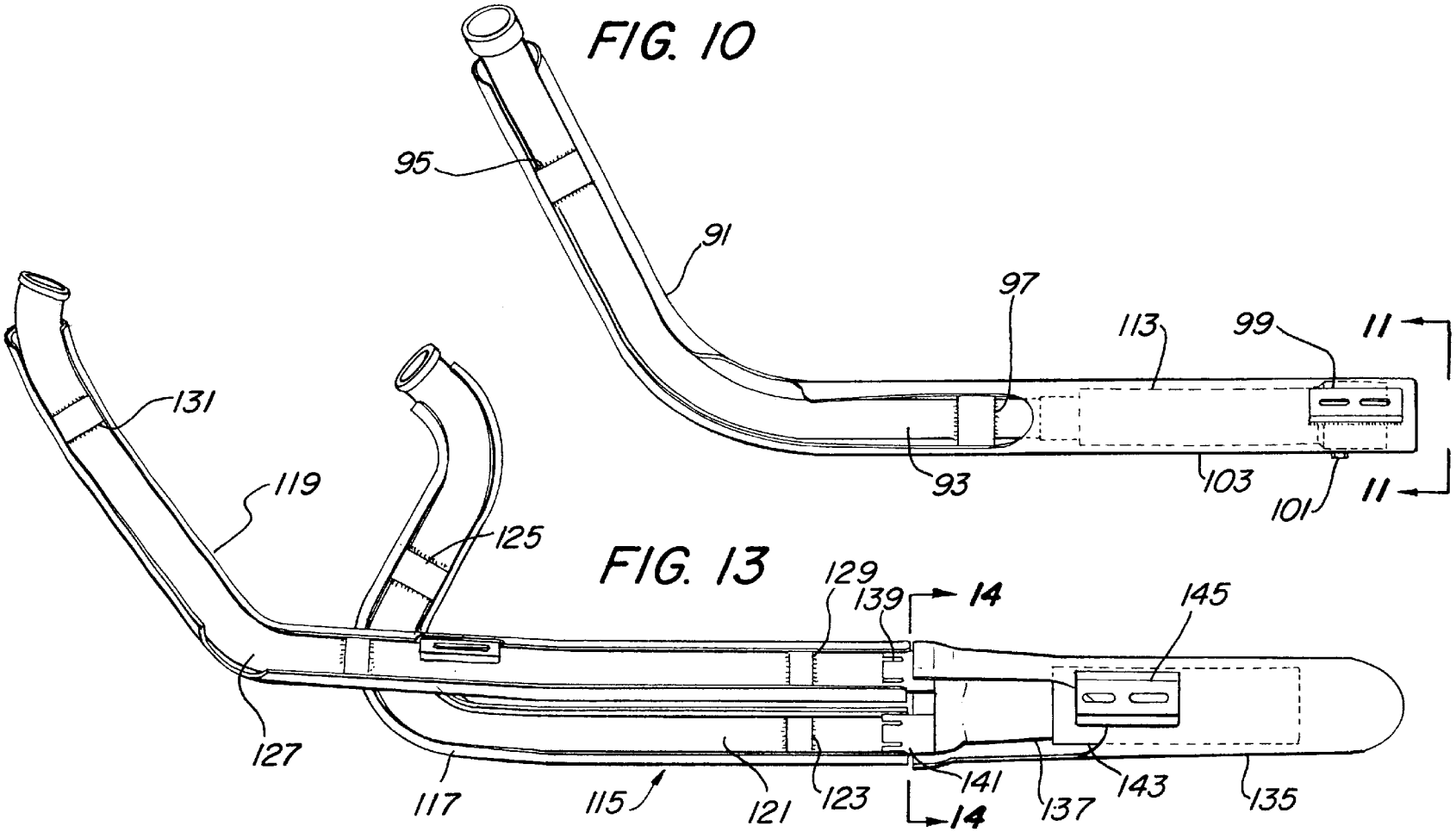
FIG. 10 is a perspective of a preferred embodiment of a double wall pipe and muffler according to the present invention.
FIG. 13 is a perspective of a preferred embodiment of a double wall pipe and muffler for dual pipes according to the present invention.

Refer now to FIG. 10 which shows an alternate preferred embodiment of the double wall exhaust pipe and muffler combination 91 according to the present invention. The interior hot exhaust gas bearing pipe 93 is fastened in a spaced apart relationship to the exterior larger diameter exhaust pipe 103 by means of welded brackets 95 and 97 that are welded to both the interior pipe 93 and the outside pipe 103 at the backside cut-out section of exterior pipe 103.

Figure 11:
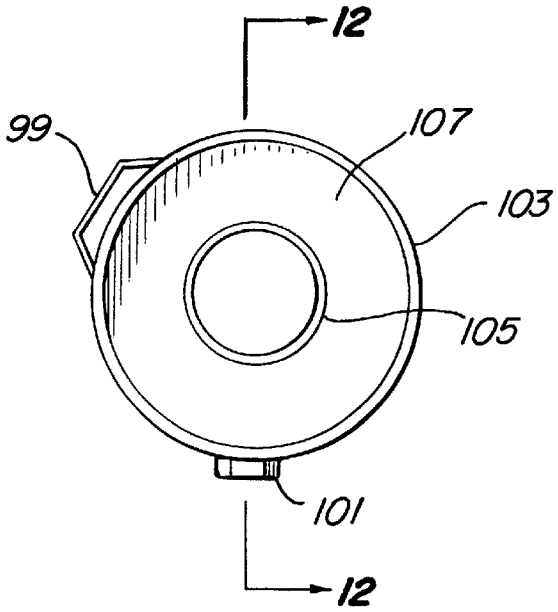
FIG. 11 is a cross section view of FIG. 10 looking in the direction of the arrows 11—11.
Figure 12:
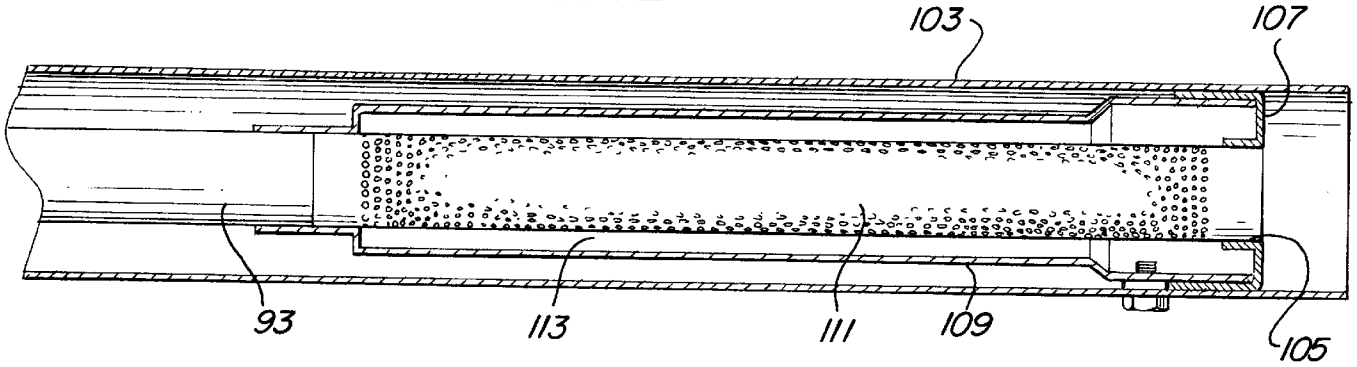
FIG. 12 is a cross-section of the muffler end of the preferred embodiment of FIG. 10 looking in the direction of the arrows 12—12.

The muffler core 113, as illustrated in FIGS. 11 and 12 and explained below, attaches to interior pipe 93 through a slip joint mechanism, or some other convenient means. The muffler core 113 is fully contained within exterior pipe 103. It is held in spaced apart relation to exterior pipe 103 at the output end by a bolt 101. A mounting bracket 99 is attached to the underside of exterior pipe 103.

Looking at the end of exterior pipe 103 in the direction of arrows 11—11 in FIG. 10, one sees the view shown in FIG. 11, the exterior pipe 103, mounting bracket 99, and bolt 101 passing through exterior pipe 103 to hold a spacing baffle 107 in place which spaces the exhaust end 105 of the baffle core 111 (FIG. 12) symmetrically within outer pipe 103.

The baffle core 111 is mounted within an interior casing 109 in a spaced apart relationship. The combination of baffle core 111 and interior casing 109 making up the muffler core 113 is mounted by output baffle 107 in a spaced apart relationship from exterior pipe 103.

The hot gases coming from the engine through internal hot gas pipe 93 flow into muffler core 113, are defused through the apertures in baffle core 111, thereby creating a mellowing of the exhaust gas sound as it flows out of the output aperture 105 of baffle core 111.

FIG. 13 illustrates an alternate preferred embodiment of a double wall pipe and muffler combination 115 according to the present invention wherein dual exhaust pipes are connected to a single muffler structure. Both exhaust pipe 119 and exhaust pipe 117 have internal hot gas bearing pipes 127 and 121, respectively. These hot gas bearing pipes are spaced part from and held firmly inside their external pipes by way of welded straps 113, 129, and 123, 125 at the open end of external pipes 119 and 117.

The double wall muffler 135 has contained within it a Y-shaped collector 137 which is mounted in a spaced apart relationship to the exterior wall of double wall muffler 135. The two input ends 139 and 141 of collector 137 slip into the output ends of the internal pipes 127 and 121. The output end of collector 137 funnels all the gases from both pipes into the muffler core 143 contained within the exterior wall of muffler 135. A mounting bracket 145 is attached to the exterior wall of muffler 135 for mounting that end of the entire assembly to a motorcycle.

Figure 14:
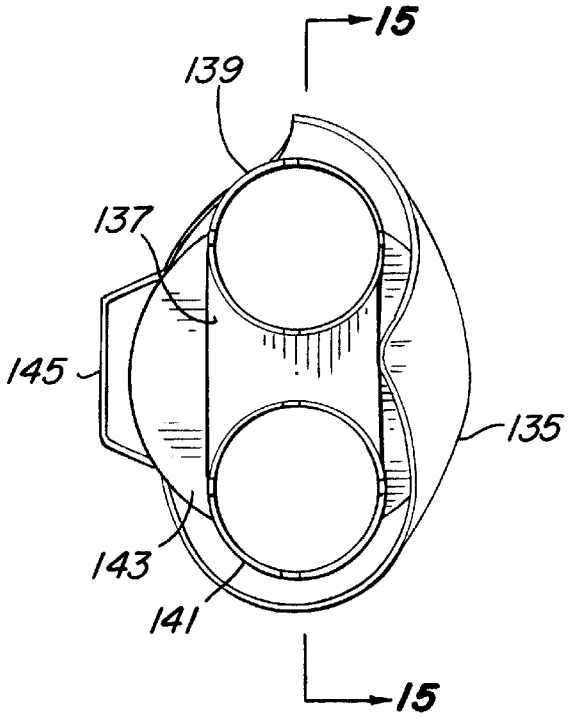
FIG. 14 is a cross-section view of FIG. 13 looking in the direction of arrows 14—14.
Figure 15:
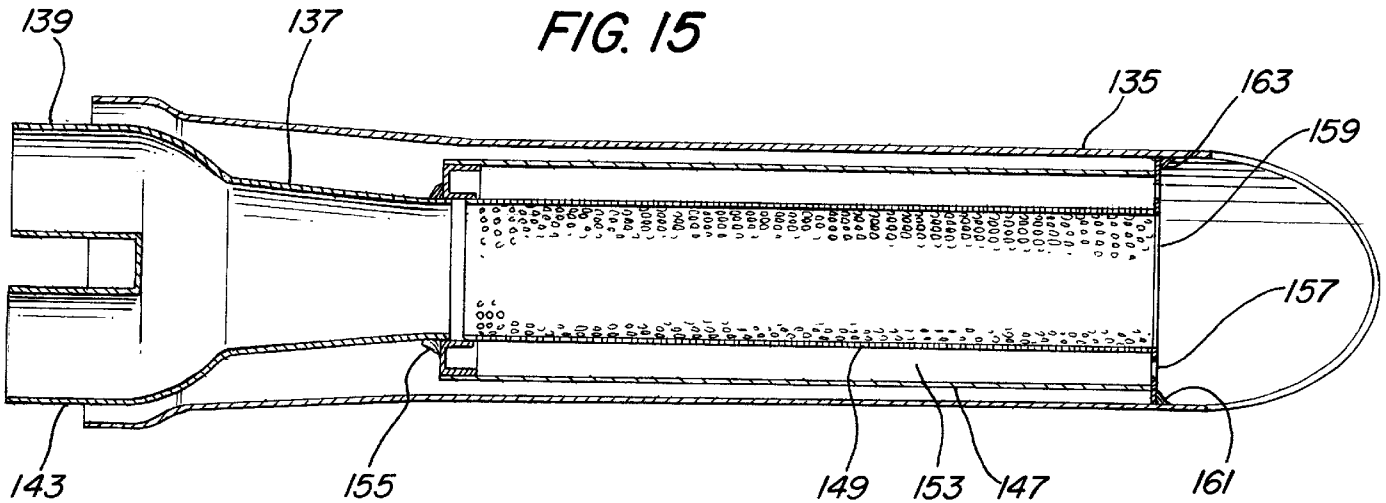
FIG. 15 is a cross-section of the muffler end of the preferred embodiment of FIG. 13 looking in the direction of arrows 15—15.

Looking at the input end of double wall muffler 135 in the direction of arrows 14—14, one sees the view shown in FIG. 14 input pipes 139 and 141 of the Y-shaped collector 137 and the input end of the muffler core 143, all of which is more clearly illustrated in the cross section of FIG. 15 looking in the direction of arrows 15—15.

The external wall of muffler 135 surrounds the muffler core 153 and the collector 137. The output end of collector 137 is welded to the input end of muffler core 153. Muffler core 153 comprises a baffle core 149 contained within an interior casing 147 for maintaining the hot gases trapped therein and out of contact with the exterior wall of the double wall muffler 135. The output end 159 of baffle core 149 is held in place by an output baffle 157, which is welded to the outer skin of the double wall muffler 135 by welds 163, 161. The output baffle 157 allows output gases to flow only through the output aperture of baffle core 149.

What is claimed is:

1. A decorative exhaust pipe for conveying hot exhaust gases, comprising:

a continuous one-piece interior exhaust pipe having a first end and a second end, the first end of the interior exhaust pipe adapted for mounting to an exhaust header of an engine;

a muffler core having a baffle core enclosed in a casing with an input end and an output end, fastened to the second end of the interior exhaust pipe; and a continuous exterior pipe having a first end and a second end sized to contain the interior exhaust pipe and the muffler core in a spaced apart relation, the back side of the exterior pipe having an aperture running along a portion of its length.

2. The decorative exhaust pipe of claim 1 wherein the aperture in the exterior pipe extends from the first end to the muffler core.

3. The decorative exhaust pipe of claim 1 wherein the aperture running along the back side of the exterior pipe is sized to permit the diameter of the interior exhaust pipe to fit therethrough.

4. The decorative exhaust pipe of claim 3 further comprising a spacer welded to the interior exhaust pipe and the exterior exhaust pipe at the aperture running along the back side of the exterior pipe, at the first end, to keep the interior exhaust pipe spaced at a fixed distance from the exterior pipe.

5. The decorative exhaust pipe of claim 3 further comprising a mounting bracket attached to the interior exhaust pipe and the exterior pipe at its back side for keeping the interior exhaust pipe spaced at a fixed distance from the exterior pipe and mounting the decorative exhaust pipe.

6. The decorative exhaust pipe of claim 3 further comprising a spacer welded to the second end of the interior exhaust pipe to keep the interior exhaust pipe and muffler core spaced at a fixed distance from the exterior pipe.

7. The decorative exhaust pipe of claim 3 further comprising a spacer baffle attached to the output end of the muffler core to keep the output end of the muffler core spaced at a fixed distance from the exterior pipe and cause all exhaust gas to flow only out of the output end of the muffler core.

8. The decorative exhaust pipe of claim 1 wherein the muffler core comprises:

a core for baffling the noise of the exhaust gases having a first end with an inlet to receive hot gases, and a second end with an outlet for discharging hot gases; and an interior casing surrounding the baffle core except for the inlet and the outlet and being fixedly attached to the first and second ends of the noise baffling core.

9. The decorative exhaust pipe of claim 8 wherein the aperture extends from the first end of the exterior pipe to the muffler core.

10. The decorative exhaust pipe of claim 9 wherein the aperture in the exterior pipe is sized to pass the diameter of the interior exhaust pipe therethrough.

11. The decorative exhaust pipe of claim 10 further comprising a spacer welded to the interior exhaust pipe and the exterior exhaust pipe at the aperture of the exterior exhaust pipe for keeping the interior exhaust pipe spaced at a fixed distance from the exterior pipe.

12. A set of dual decorative exhaust pipes for conveying hot exhaust gases, comprising:

a first continuous one-piece interior exhaust pipe having a first end and a second end, the first end being adapted for mounting to an exhaust generating source;

a second continuous one-piece interior exhaust pipe having a first end and a second end, the first end being adapted for mounting to an exhaust generating source;

a muffler core having a baffle core enclosed in a casing with an input end and an output end, the input end being fastened to the second end of the first interior exhaust pipe and the second end of the second interior exhaust pipe;

a first continuous exterior pipe having a first end and a second end sized to contain the first interior exhaust pipe in a spaced apart relation, the back side of the first exterior pipe having an aperture running along its length;

a second continuous exterior pipe having a first end and a second end sized to contain the second interior exhaust pipe in a spaced apart relation, the back side of the second exterior pipe having an aperture running along its length; and a third continuous exterior pipe having a first end and a second end sized to contain the muffler core in a spaced apart relation and completely surrounds the muffler core, the first end starting at the input end of the muffler core casing.

13. The set of dual decorative exhaust pipes of claim 12 wherein the apertures running along the back side of the first exterior pipe and the second exterior pipe are sized to permit the diameter of the respective interior exhaust pipes to fit therethrough.

14. The set of dual decorative exhaust pipes of claim 13 further comprising:

a first spacer welded to the first interior exhaust pipe and to the first exterior exhaust pipe, at the aperture of the first exterior pipe, to keep the first interior exhaust pipe spaced at a fixed distance from the first exterior pipe; and a second spacer welded to the second interior exhaust pipe and to the second exterior exhaust pipe, at the aperture of the second exterior pipe, to keep the second interior exhaust pipe spaced at a fixed distance from the second exterior pipe.

15. The set of dual decorative exhaust pipes of claim 12 wherein the muffler core comprises:

a Y-shaped collector having an input end on an output end, the input end being connected to the second end of the first interior exhaust pipe and the second end of the second interior exhaust pipe;

a core for baffling the noise of the exhaust gases having a first end with an inlet connected to output end of the collector to receive hot gases, and a second end with an outlet for discharging hot gases; and an enclosure surrounding the baffle core except for the inlet and the outlet and fixedly attached to the first and second ends of the baffle core.

* * * * *